US005295694A

United States Patent [19]

Levin

[11] Patent Number: 5,295,694

[45] Date of Patent: Mar. 22, 1994

[54] LAPAROSCOPIC SURGERY SIMULATING GAME

[76] Inventor: John M. Levin, 412 Fairview Rd., Narberth, Pa. 19072

[21] Appl. No.: 977,932

[22] Filed: Nov. 18, 1992

Related U.S. Application Data

[63] Continuation-in-part of Ser. No. 966,984, Oct. 27, 1992, abandoned.

[51] Int. Cl.[5] ..... A63F 9/00

[52] U.S. Cl. ..... 273/447; 128/898; 273/DIG. 24; 606/205; 434/272

[58] Field of Search ..... 273/447, 448, 113, 109, 273/DIG. 24; 606/170, 174, 205, 206, 210; 128/898; 434/267, 272, 273

[56] References Cited

U.S. PATENT DOCUMENTS

| | | | |
|---|---|---|---|
| 277,120 | 5/1883 | Davenport | 273/109 |
| 2,460,146 | 1/1949 | Prentice | 273/447 |
| 3,724,848 | 4/1973 | Glass et al. | 273/447 |
| 3,734,497 | 5/1973 | Brown | 273/DIG. 24 X |
| 3,917,264 | 11/1975 | Davidson et al. | 273/DIG. 24 X |
| 3,971,560 | 7/1976 | Panosh | 273/DIG. 24 X |
| 4,177,987 | 12/1979 | Zimmerman | 273/447 X |
| 4,272,075 | 6/1981 | Rogers, Jr. | 273/448 |
| 4,936,590 | 6/1990 | Palmer | 273/DIG. 24 X |
| 5,133,735 | 7/1992 | Slater et al. | 606/205 |
| 5,149,270 | 9/1992 | McKeown | 434/267 X |
| 5,224,931 | 7/1993 | Kumar | 606/205 X |

FOREIGN PATENT DOCUMENTS

| | | | |
|---|---|---|---|
| 2227870 | 12/1973 | Fed. Rep. of Germany | 273/447 |

OTHER PUBLICATIONS

Sears 1966 Christmas Catalog, Dec. 1966 p. 569 Operation.

Sears 1969 Christmas Catalog, Nov. 1969 p. 486 Operation.

*Primary Examiner*—Paul E. Shapiro

*Attorney, Agent, or Firm*—Caesar, Rivise, Bernstein, Cohen & Pokotilow, Ltd.

[57] ABSTRACT

A game and method of playing it to simulate a minimally invasive surgical procedure. The game comprises, a base member over which a transparent domed cover having a pair of openings is located. The cover defines a work space thereunder. The base member includes a graphic likeness of a being, e.g., a woman at the bottom of the work space. A plurality of anatomic parts shaped to simulate internal organs of the being are located in respective cavities at anatomically appropriate places on the graphic likeness. A lifting instrument simulating a conventional laparoscopic instrument is provided to be extended through one opening in the cover to grasp and lift the anatomic part out of its cavity without touching the cavity with the instrument, else a lamp on the base member is automatically illuminated and a buzzer sounds. An extraction instrument simulating another conventional laparoscopic instrument is provided to be extended through another opening in the cover to enable the lifted anatomic part to be transferred to the extraction instrument so that it can be taken out of the work space by the extraction instrument. Plural cards are provided to establish the surgical procedure to be attempted by each player. Play money is provided as a fee for each player who successfully completes a surgical procedure.

19 Claims, 3 Drawing Sheets

52
28C
10
2
32
48
36
30C
42B
26B
54
18
42A
26A
60
42E
42D
22
26
42C
26C
26D
62
24
42F
26F
26G
42G
26H
26I
2
28B
20
30B
28
28A
30
30A

LAPAROSCOPIC SURGERY SIMULATING GAME

RELATED APPLICATIONS

This application is a continuation-in-part of U.S. patent application Ser. No. 07/966,984, filed on Oct. 27, 1992, now abandoned, and entitled LAPAROSCOPIC SURGERY SIMULATING GAME, the subject matter of which is incorporated herein by reference.

BACKGROUND OF THE INVENTION

This invention relates generally to games, and more specifically to games simulating laparoscopic surgery.

Children are almost universally fascinated by doctors and medicine. Thus, various toy manufacturers have provided toys and games relating to medicine for play by children. Many of such games and toys are not only fun but are somewhat educational, as well. For example, Milton Bradley Company of Springfield Mass., a subsidiary of Hasbro, Inc., offers a game under the registered trademark "OPERATION" to provide a humorous simulation of surgery on a person. In particular, that game consists of a plastic-framed platform in which a cardboard panel bearing the image of a cartoon-like male patient (designated as "Cavity Sam") is located. An electrically conductive panel is located under the cardboard panel and is connected to one pole of a pair of batteries. A light bulb extending out a hole in the cardboard panel at the location of Cavity Sam's nose is electrically connected to the electrically conductive panel. A buzzer is also provided connected to the electrically conductive panel. The other pole of the batteries is connected to a pair of electrically conductive tweezers. A plurality of different, uniquely shaped openings are provided in the cardboard panel at various locations on the anatomy of Cavity Sam. The electrically conductive panel includes correspondingly shaped openings, but smaller in size than the openings in the cardboard panel, so that the periphery of the conductive panel about each opening therein is exposed.

The plastic platform includes plural cavities located under the openings in the cardboard and electrically conductive panels and into which respective molded plastic objects (designated as "FUNATOMY objects") are to be located. Each of these objects is humorously related to a respective portion of the anatomy of Cavity Sam. For example, one object is shaped like a bone and is located in a correspondingly shaped cavity designated on the arm portion of Cavity Sam's anatomy as a "funny bone." Another object is heart shaped is located in a correspondingly shaped cavity designated on the chest of Cavity Sam as a "broken heart." Still another object is shaped like a pail of water, is located in a correspondingly shaped cavity on Cavity Sam's knee and is designated as "water on the knee."

The object of the "OPERATION" game is for the players to utilize the tweezers to remove the FUNATOMY objects from their respective cavities without touching the electrically conductive perimeter of those cavities with the tweezers during the extraction process, thereby simulating the successful performance of an operation. If the player should touch the perimeter of the cavity with the tweezers such action completes the electrical circuit and causes the buzzer to sound and the lamp to illuminate. The "OPERATION" game bears the designation "U.S. Pat. No. 3,333,846."

Conventional surgery is now giving way to various procedures and techniques referred to as "minimally invasive surgery." In such surgery no large incision is made to gain access to the organ or internal structure to be operated upon. Instead access to the organ or internal structure is achieved through a small percutaneous incision or puncture. For example, removal of the gall bladder is now frequently being accomplished laparoscopically. Such a procedure entails insufflating the patient's abdomen with a gas, e.g., carbon dioxide, and then inserting a laparoscope (a viewing instrument) via a trocar extending through a small puncture to provide the surgeon with a view of the interior of the patient's body. Various types of small diameter, elongated instruments are arranged to be inserted through respective trocars into the insufflated abdomen to effect the reflection (i.e., positioning) of adjacent tissue, e.g., a lobe of the liver, to expose the gall bladder and to enable it to be removed. Once the procedure has been accomplished the instruments and trocars are removed, and the small punctures in the abdomen sealed, e.g., sutured. Since the procedures do not require large incisions, trauma to the patient is minimized and recovery times are accelerated.

The public at large, and children in particular, are generally unfamiliar with the concepts and techniques of minimally invasive surgery, such as laparoscopic surgery. Thus, a need exist for a game which provides an educational experience relating to such new surgical technologies, and which will be fun for children to play.

OBJECTS OF THE INVENTION

It is a general object of this invention to provide a game which overcomes the disadvantage of the prior art.

It is a further object of this invention to provide a game which is entertaining, yet and which provides a learning experience about newly developing surgical procedures, e.g., minimally invasive surgery.

It is still a further object of this invention to provide a game which simulates laparoscopic surgery and which fosters the development of manual dexterity.

SUMMARY OF THE INVENTION

The above and other objects of this invention are achieved by providing a game and method of playing it to simulate a minimally invasive surgical procedure. The game comprises, a base member, a cover member, signaling means, a plurality of anatomic members shaped to simulate internal organs of a being, and a lifting instrument. The base member bears a graphic likeness of the anatomy of the being, e.g., a female human being, and includes plural cavities disposed at preselected portions in that likeness. Each of the preselected portions in the likeness corresponds to the location of an anatomical organ of the being which is located thereat. The plurality of anatomic members are located in respective ones of the cavities.

The cover member comprises a wall disposed over the portion of the base member which includes the cavities and defines a work space therebetween. The cover member includes a first opening to enable a distal portion of the lifting instrument to be extended therethrough into the work space while a proximal portion of the lifting instrument is located outside of the work space. The distal portion of the lifting instrument includes means for selectively grasping and lifting each of the anatomic members out of their respective cavities when the distal portion of lifting instrument is extended through the first opening.

The signaling means is coupled to all of the cavities for providing a output signal, e.g., the illumination of a lamp and the sounding of a buzzer, in the event that the distal portion of the lifting instrument engages a portion of any cavity as the anatomic member located therein is lifted thereout.

In accordance with one preferred embodiment of the invention the game also includes an extraction instrument and a second opening in the cover member. The extraction instrument is inserted through the second opening so that an anatomic object lifted out of its cavity by the lifting instrument can be transferred to the extraction instrument within the work space, and once so transferred carried out of the work space through the second opening in the cover member.

In accordance with some aspects of the methods of this invention the players attempt to remove those anatomic members which are designated on cards which are included in the game and which are selected by the players during the game's play. Those players successfully removing the anatomic members earn fees associated with the particular procedure accomplished, as also designated on the cards. The players are paid with play money provided with the game.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein.

DESCRIPTION OF THE PREFERRED EMBODIMENTS OF THE INVENTION

Figure 1:
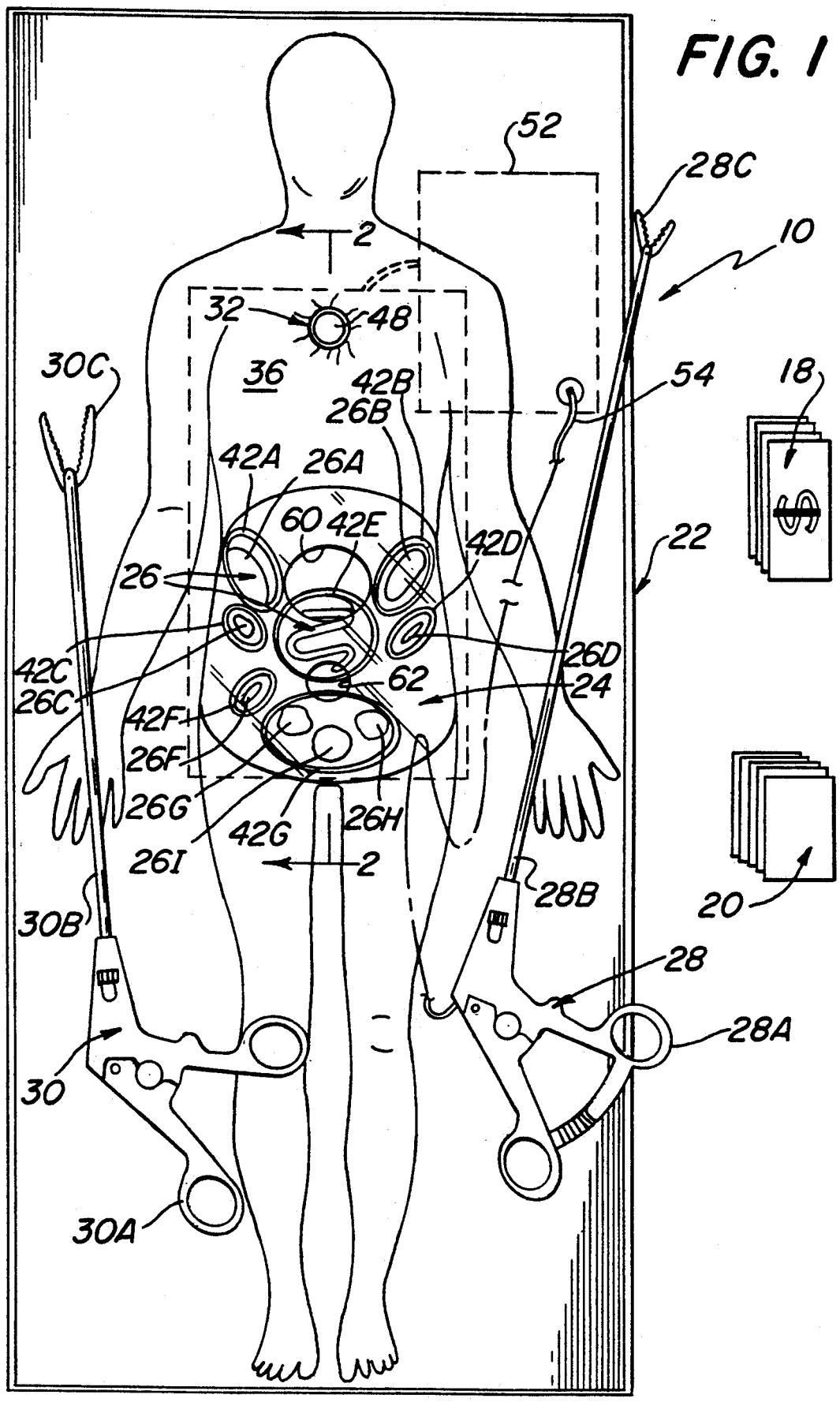
FIG. 1 is an plan view of a game constructed in accordance with this invention.

Referring now in greater detail to the various figures of the drawings wherein like reference characters refer to like parts, a game embodying the present invention is generally shown at 10 in FIG. 1. The game 10 basically comprises a plurality of play money 18, a plurality of playing cards 20, a base member 22, a cover 24 (FIG. 2), a plurality of anatomic members or parts 26, a pair of instruments 28 and 30, and a signalling circuit 32.

Figure 2:
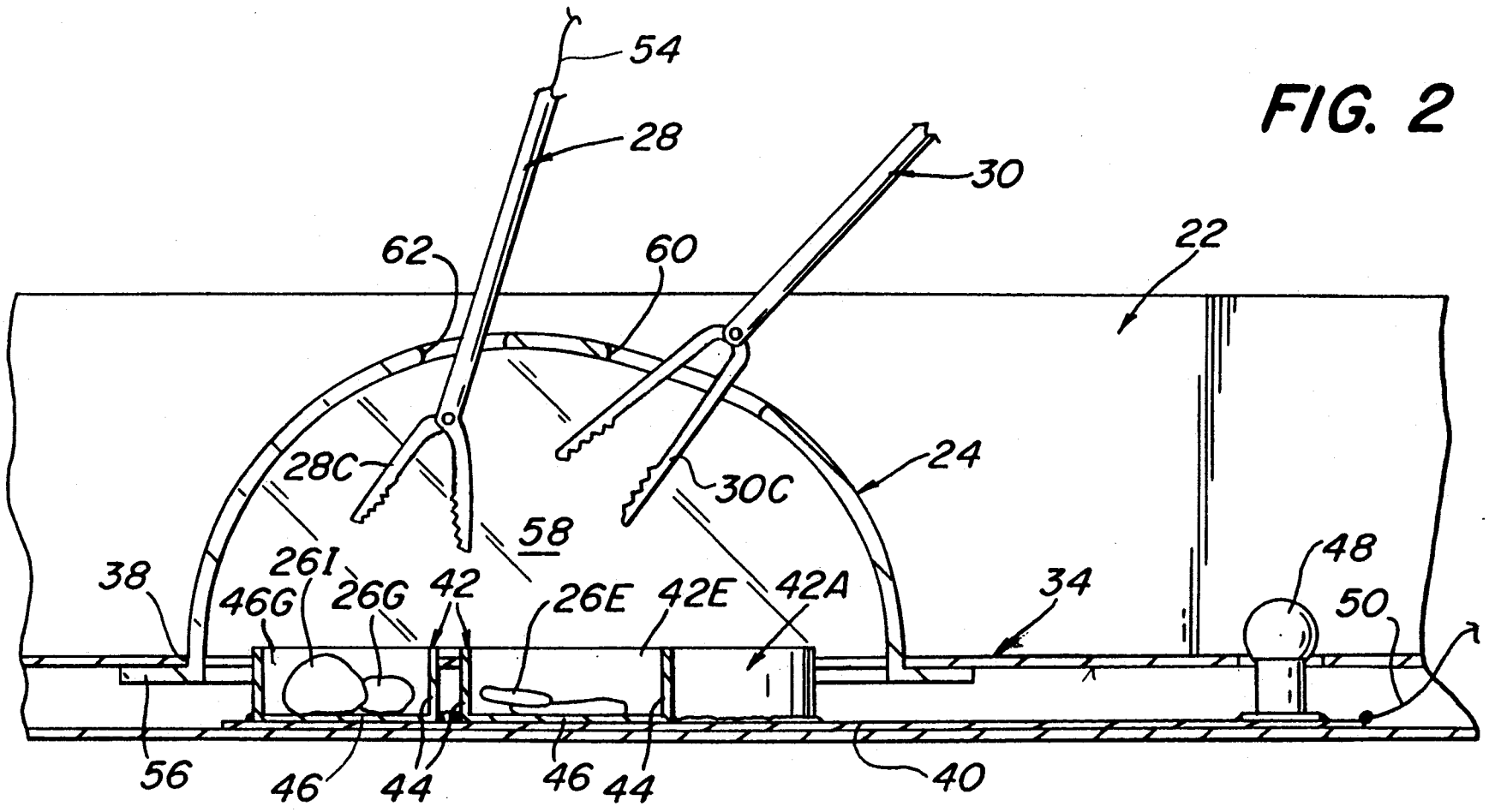
FIG. 2 is an enlarged sectional view taken along line 2—2 of FIG. 1.

As can be seen clearly in FIG. 2 the base member 22 comprises a housing having a planar top panel 34 bearing the graphic image 36 (FIG. 1) or likeness of a woman thereon. The base member is formed of any suitable material, e.g., plastic. A large opening 38 is provided in the top panel and encompasses the abdomen area of the image 36. A planar lower panel 40 is located within the base member below the top panel so that a portion of it is visible through the opening 38. The visible portion of the lower panel 40 includes a plurality of cup shaped members 42 mounted thereon at respective locations corresponding to the location of various organs of the woman depicted in the graphic image 36. Moreover, some of the cup shaped members are configured to correspond to the shape of the organ which is located at the position where the cup shaped member is located. In any case each cup shaped member defines a cavity which is arranged to have located therein a respective one or more than one of the anatomic parts 26.

In accordance with the embodiment of the invention shown herein the anatomic parts 26 are formed of any suitable material, e.g., a plastic, and are shaped to simulate respective organs of the woman. In particular, the parts 26 comprise a pair of parts 26A and 26B, shaped like the kidneys, a part 26C shaped like the gall bladder, a part 26D shaped like the spleen, a part 26E shaped like the bowel, a part 26F shaped like the appendix, a pair of parts 26G and 26H shaped like the ovaries, and a part 26I shaped like the womb. The kidney parts 26A and 26B are located in cavities 42A and 42B, the gall bladder part 26C is located in cavity 42C, the spleen part 26D is located in cavity 42D, the bowel part 26E is located in cavity 42E, the appendix part 26F is located in cavity 42F, the ovary parts 26G and 26H and the womb part 26I are all located within the cavity 42G.

It must be pointed out at this juncture the organ parts 26 and cavities 42 in which they are located as described above is merely exemplary. Thus, the parts 26 may be constructed to simulate any number(s) or type(s) of organs. Moreover, the cavities 42 may be shaped to correspond to the periphery of the organ part 26 or may be of any desirable shape, and the number of organ parts located within any particular cavity can also be selected as desired. Furthermore, the image 36 on the base member need not be that of a woman, but can be a man, a child, or even animal. In regard to the latter, the image can be of an animal if it is desired to provide a game to simulate veterinarian laparoscopic surgery.

As can be clearly seen in FIG. 2 each cup shaped member 42 includes an upstanding sidewall 44 and a base wall 46. The side walls and base walls are all formed of an electrically conductive material, e.g., a metal. The lower panel 40 is also formed of an electrically conductive material, e.g., metal, with the cup shaped members being secured, e.g., soldered, thereto so as to be in electrical continuity therewith. These electrically conductive components form a portion of the heretofore identified signalling circuit 32. That circuit also includes a lamp 48 mounted on and in electrical continuity with the base panel 40 and the cup shaped members 42 mounted therein. An electrical wire 50 is connected, e.g., soldered, to the panel 40 and extends into a chamber 52 (shown by the phantom lines in FIG. 1) located within the base member. One or more conventional batteries, e.g., D cells, (not shown) is(are) located within the chamber 52 and one pole of that(those) battery(ies) is electrically connected to the wire 50. The other pole of the battery(ies) is(are) connected via a wire 54 to the instrument 28. A buzzer (not shown) is also located within the chamber 52 as is electrically connected in series with the lamp 48.

In accordance with a preferred embodiment of this invention each instrument is constructed to simulate in appearance and operation a respective conventional laparoscopic instrument. Thus, the instrument 28 comprises a lifting instrument including a handle portion 28A arranged to be held in one hand of a player of the game, an elongated portion 28B terminating in a distally located working head, e.g., a pair of jaws, 28C. The jaws 28C are formed of an electrically conductive material, e.g., a metal, and are in electrical continuity with the wire 54. The instrument 30 comprises an extracting instrument and includes a handle portion 30A arranged to be held in the other hand of a player of the game, an elongated portion 30B terminating in a distally located working head, e.g., a pair of longer toothed jaws 30C.

As can be seen in FIG. 2 the cover 24 is a convex or domed shaped member to simulate an insufflated abdomen and, in one preferred embodiment of this invention, is formed of a transparent material, e.g., a plastic, to enable the players to see through it. The cover 24 includes a peripheral flange 56 which is disposed under the top panel of the base member contiguous with the opening 38 to secure the cover to the base member thereat. The interior space between the inner surface of the cover 24 and the base member simulates the interior of the insufflated abdomen and thus defines the surgical work space 58. Access to the surgical work space 58 for the instruments 28 and 30 is provided by a pair of openings 60 and 62 in the cover. In particular the opening 60 is located in the cover so that it is adjacent the bowel and kidneys. The opening 62 is smaller in size and is located adjacent the bowel and ovaries.

The handle portion 28A of the lifting instrument 28 is arranged to be held in one hand of the player of the game so that he/she can manipulate the instrument to extend its distal end portion through the opening 62 until the jaws 28C are immediately adjacent a desired anatomic part 26 within its associated cavity 42. The handle portion 28A is then operated by the player's fingers to cause the instrument's jaws 28C to open around the anatomic part without touching the bottom panel 40 or the side wall 44 or base wall 46 of the cavity containing that member. Then the instrument's handle portion is operated to cause its jaws to close on the anatomic part to grasp it therebetween. The instrument is then to be manipulated by the player to withdraw or remove the grasped anatomic part from its cavity without touching the instrument's jaws to the side wall or base wall of the cavity or the bottom panel 40.

As will be appreciated by those skilled in the art if in manipulating the instrument 28 its jaws 28C contact either the side wall or base wall of the cavity or the bottom panel 40 an electrical circuit is completed between the battery(ies) the buzzer, and the lamp 48, thereby causing the lamp to light and the buzzer to sound. This indicates that the player has not performed the surgical procedure correctly.

The extraction instrument 30 is arranged to be held in the other hand of the player and manipulated so that its distal end is extended through the opening 60 in the cover 24, whereupon its jaws 30C are located within the work space 58. When a player has successfully removed an anatomic part from its cavity, i.e., without causing the lamp to illuminate and the buzzer to sound, the player must then transfer the anatomic part from the lifting instrument 20 to the extraction instrument 30 so that it can be removed from the work space by the extraction instrument.

The anatomic part retrieval, transfer, and extraction process takes considerable manual dexterity for a child to ensure that the anatomic part is removed without causing the lamp to light and the buzzer to sound and is not dropped during its transference from between the jaws 28C of the lifting instrument to between the jaws 30C of the extraction instrument. If the anatomic part is dropped it must be retrieved and lifted up by the lifting instrument, with care being taken to ensure that the lifting instrument's electrically conductive jaws 28C do not make contact with any cup shaped member 42 or the electrically conductive bottom panel 40.

In accordance with a preferred embodiment of this invention the opening 62 through which the lifting instrument 28 is inserted is small so that it will preclude any of the anatomic parts 26 from being withdrawn from the work space 58 through that opening.

The game 10 can be played in various ways by one or more players. One object of the game can be to perform the laparoscopic surgery successfully, i.e., removing the anatomic part from the patient with the instruments 28 and 30, so that the surgeon (player) earns his fee, which is paid from a "bank" with the play money 18. The particular organ (anatomic part) which is to be removed can be selected in various ways, one of which is by use of the cards 20.

The following description of the play of the game 20 is exemplary of one preferred manner and is to some degree similar to the manner in which the "OPERATION" game is played. Other ways of play will be apparent to those skilled in the art. In the following exemplary mode of play, the cards 20 are used. These cards are constructed so that each bears indicia indicating a type of laparoscopic surgery or procedure to be performed by the player selecting that card, and the amount of money the player is to receive for successful performance of that procedure/surgery. For example, one card bears the indicia "Gall Bladder" and "Fee—$2000", thereby indicating that the player choosing that card has to perform a gall bladder removal, and if accomplished successfully he/she will receive $2000 in play money 18 from the "bank". Some of the cards bear the indicia "Specialist" and include an associated fee, to indicate that if the player is a "specialist" and performs the surgery successfully, he/she is entitled to the specialist fee (which is higher than the ordinary surgical fee) . For example the gall bladder "specialist fee" appearing on the gall bladder card is $3000.

Play commences as follows: The cards 18 are placed in a stack face down on the playing surface on which the base member 22 is disposed. The players take turns, with each selecting the then top card from the stack. The first player then reads the top card aloud to tell him/her and the others which laparoscopic surgery or procedure he/she is to perform and what fee he/she will receive if he/she performs it successfully. For example, if the player picks the "gall bladder" card described above, if he/she performs that operation successfully he/she will receive $2000 in play money 18.

The player, then uses the lifting instrument 28 as described above to insert its distal end carefully into the working space and grasps the gall bladder part 26C with the instrument's jaws 28C, making sure not to touch the cavity 42C in which the gall bladder part is located (or the bottom panel 40 on which the cavity 42C is located) . The player then lifts the grasped gall bladder part up into to work space 58, to transfer it to the jaws 30C of the extraction instrument 30. Then using that instrument the player has to carry the gall bladder part out of the working space through the opening 60, to "successfully" complete the surgery. If the lamp 48 should illuminate and the buzzer sound, because the player's lifting instrument touched a conductive portion in the base member, the player is deemed to have failed to complete the surgery successfully. Accordingly, the player does not earn his/her fee. When this happens, the gall bladder part is replaced back into its cavity and the player's turn ends.

The next player can either attempt the procedure of the card he/she had selected, e.g., an appendectomy, and if successful earn the fee for that procedure, or can attempt the procedure which the previous player had failed to perform, e.g., the gall bladder surgery. If he/she elects to attempt the procedure that the previous player failed and is successful in accomplishing that procedure, he/she is deemed to be a "specialist" and earns the "specialist fee" set forth in the card, e.g. $3000. If the attempted procedure is not accomplished successfully by the player then being the "specialist", the anatomic part is replaced in its cavity and the card for that part is replaced face down at the bottom of the pile of cards.

Some surgical procedures called for in the cards do not require a "specialist", and hence the cards for such procedures do not include a "specialist fee." In the case that a player has selected a "non-specialist" card, if the player fails to successfully perform the designated surgery or procedure, the anatomic part, if removed from its cavity is replaced in the cavity, the card designating the failed procedure is placed face down at the bottom of the pile of cards, and the next player has to attempt the surgery or procedure indicated on the card he/she had picked. Thus, the next player cannot attempt the failed procedure at that time.

Each player is given a predetermined time period, e.g., one minute, for accomplishing the selected procedure. This time is kept by a designated player not then performing the operation. If the procedure is not accomplished within the designated time period the surgery/procedure is deemed to have not been accomplished successfully and the player does not get the requisite fee, the anatomic part (if removed from its cavity) is replaced, and the card designating that procedure placed face down at the bottom of the pile. Alternatively, the players may by agreement allow procedures to be deem completed "successfully" even if it takes longer than the designated time. In that case the player only earns half of the designated fee.

The play of the game proceeds until all of the laparoscopic surgeries have been successfully completed. The player with the most money at that time is deemed to be the winner.

The game can be played without the cards or money. In such a mode of play the players can select the anatomic part to be removed by each player in his/her turn. In the event that a player drops the selected anatomic part from either the lifting instrument 28 or the extraction instrument 30 during the procedure, the anatomic object is left where it is dropped (it is not returned to its cavity—as described above). The next player must then use the instrument 28 to lift the anatomic part from wherever it happens to be and then transfer it to the extraction instrument 30 to carry it out of the cover. Care must be taken during this procedure by the player not to touch any of the cavities 42 or the bottom panel 40 or else the surgery will be deemed "unsuccessful" and the next player will have his/her turn to complete the surgery.

In an alternative manner for playing the game each person is required to declare, in advance, the specific organ or anatomic part he or she intends to remove from the body. In the event that the person playing the game then picks up and attempts to remove the wrong anatomic part the other players can verbally declare "malpractice", in which case the person picking up or attempting to pick up the incorrect organ will be required to forfeit either all or part of the money he or she made prior to the act of "malpractice."

A single player may play the game as a test of his/her skill and as a means for increasing his/her manual dexterity by trying to perform all of the laparoscopic surgeries within a designated time period. In such a case if he/she is unsuccessful in any procedure, he/she replaces the removed anatomic parts and starts all over again.

It should be pointed out at this juncture that the distal end of the extraction instrument 30 can be electrically conductive and in electrical continuity with the signalling circuit so that if during any surgical procedure carried out by a player the distal portion of the extraction instrument should touch any of the electrically conductive portions of the base member, e.g., the cavities, the lamp will light and the buzzer sound.

Since the bottom panel 40 is electrically conductive if the grasping jaws 28C of the instrument 28 touch it the lamp will light and the buzzer sound. If it is desired to preclude such an event, so that the lamp will light and the buzzer sound only if the jaws of an instrument touch any of the cavities, an insulating material layer, e.g., cardboard, (not shown) may be placed over the bottom panel. In such an arrangement the insulating layer will have openings through which the electrically conductive cavities extend. Moreover, it is contemplated that only a portion of each of the cavities be electrically conductive, if desired.

Figure 3:
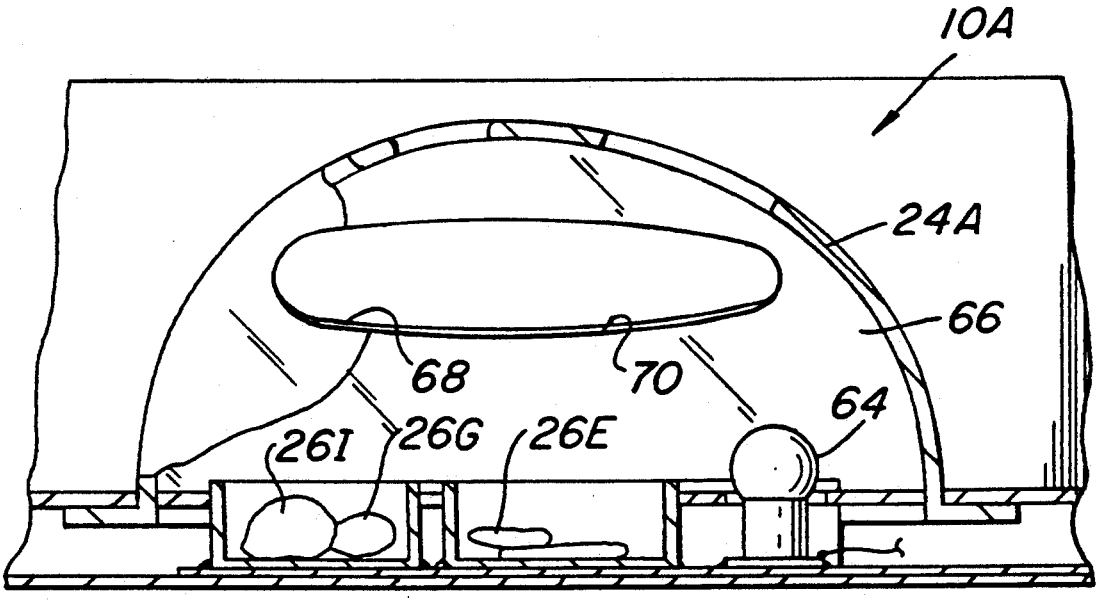
FIG. 3 is a view similar to FIG. 2, but showing an alternative embodiment of this invention.

Referring to FIG. 3, in an alternative embodiment of the game 10A, the cover 24A in which the anatomic parts 26 are enclosed is constructed to be opaque. In this embodiment a light source, such as a lamp 64 operated through a manually actuatable switch (not shown) is provided in the interior compartment 66 to light the area containing the anatomic parts 26. In this variant one or more separate viewing openings are provided in the casing, to permit a person(s) playing the game to view the anatomic parts 26 within the internal compartment as he or she manipulates the operating instruments 28 and 30. In the illustrated embodiment two such viewing openings are shown at 68 and 70, respectively. As shown in FIG. 3, these openings 68 and 70 extend through opposed curved surface regions of the cover 24A. It should be understood that the viewing openings 68 and 70 are sized to provide a clear field of view to all of the anatomic parts within the interior compartment 66.

It also is within the scope of this invention to make the outer surfaces of the anatomic parts 26 florescent, so that the game can be effectively played under "dark room" conditions simulating a power failure in the operating arena. Either the entire composition of the organs can be made of a florescent material, or alternatively, a coating of a florescent material can be provided on the organs. In a similar manner the working heads (e.g., 28C and 30C) of the instruments 28 and 30 can be provided of a florescent material or coating to effectively assist in the playing of the game under dark room conditions. It should be understood that the florescent material of the anatomic parts 26 is non-conductive, while the florescent material of the working heads of the instruments 28 and 30 is conductive, or, when in the form of a coating on a conductive, metal working head, does not insulate the head. Suitable florescent materials and coatings are well known to those skilled in the art, and do not constitute a limitation on the present invention.

Without further elaboration the foregoing will so illustrate my invention that others may, by applying current or future knowledge, adopt the same for use under various conditions of service.

I claim:

1. A game for use by a player to simulate a minimally invasive surgical procedure comprising, a base member, a cover member, signaling means, a plurality of anatomic members shaped to simulate internal organs of a being, a lifting instrument, and an extracting instrument, said lifting instrument having a distal portion and a proximal portion, said extracting instrument having a distal portion and a proximal portion, said base member bearing a graphic likeness of the anatomy of said being and including plural cavities disposed at preselected portions in said likeness, each of said preselected portions in said likeness corresponding to the location of an anatomical organ of said being which is located thereat, said plurality of anatomic members being located in respective ones of said cavities, said cover member comprising a dome-shaped wall disposed over the portion of said base member including said cavities and defining a work space therebetween, said cover member comprising a first opening which is too small to enable any of said anatomic members to pass therethrough yet which is large enough to enable said distal portion of said lifting instrument to be extended therethrough into said work space while said proximal portion of said lifting instrument is located outside of said work space, said distal portion of said lifting instrument including means for selectively grasping and lifting any of said anatomic members out of its respective cavity when said distal portion of lifting instrument is extended through said first opening by said player, said signaling means being coupled to each of said cavities for providing a output signal in the event that said distal portion of said lifting instrument engages a portion of a cavity, said cover member having a second opening large enough to enable any of said anatomic members and said distal end portion of said extraction instrument to pass therethrough, said work space being sufficiently large to enable said lifting instrument to transfer said lifted anatomic member to said extraction instrument, whereupon said extraction instrument can be used by said player to carry said lifted anatomic member out of said working space through said second opening.

2. The game of claim 1 wherein said signalling means comprises a lamp and wherein said output signal comprises the illumination of said lamp.

3. The game of claim 1 wherein said signalling means comprises a buzzer and wherein said output signal comprises the an audible sound.

4. The game of claim 1 wherein said lifting instrument is configured to replicate a conventional laparoscopic instrument.

5. The game of claim 1 wherein said lifting instrument is configured to replicate a first conventional laparoscopic instrument and wherein said extraction instrument is configured to replicate a second conventional laparoscopic instrument.

6. The game of claim 1 wherein said cover member is transparent.

7. The game of claim 1 additionally comprising play money.

8. The game of claim 1 additionally comprising cards.

9. The game of claim 1, wherein said cover member is opaque and includes an additional opening therein for viewing the work space.

10. The game of claim 9, further including illuminating means for the work space.

11. The game of claim 10, wherein the illuminating means is a light source.

12. The game of claim 1, wherein said anatomic members have outer florescent surfaces.

13. The game of claim 12, wherein the distal portion of said lifting instrument has a florescent outer surface.

14. The game of claim 13, wherein the outer florescent surfaces of the anatomic members are electrically non-conductive and the outer florescent surfaces of the distal portion of said lifting instrument is electrically conductive.

15. A method of playing a game simulating a minimally invasive surgical procedure by a player, comprising, providing a base member, a cover member, signaling means, a plurality of anatomic members shaped to simulate internal organs of a being, a lifting instrument, and an extracting instrument, said base member bearing a graphic likeness of the anatomy of said being and including plural cavities disposed at preselected portions in said likeness, each of said preselected portions in said likeness corresponding to the location of an anatomical organ of said being which is located thereat, said cover member comprising a wall having a first opening and a second opening therein, said cover member being disposed over a portion of said base member to define a work space therebetween, said lifting instrument having a distal portion and a proximal portion, said extraction instrument having a distal portion and a proximal portion, said first opening insaid cover member being is too small to enable any of said anatomic members to pass therethrough yet being large enough to enable said distal portion of said lifting instrument to be extended therethrough into said work space while said proximal portion of said lifting instrument is located outside of said work space, said second opening being large enough to enable said distal end portion of said extraction instrument and any of said anatomic members to pass therethrough, said method additionally comprising the steps of;

(a) locating each of said plurality of anatomic members in respective ones of said cavities, (b) extending said distal portion of said lifting instrument through said first opening into said work space while said proximal portion of said lifting instrument is held outside said work space, (c) operating said lifting instrument from outside said work space to grasp and lift a selected one of said anatomic members out of its respective cavity without touching said cavity with said distal portion of said lifting instrument, said signalling means coupled to each of said cavities to provide a output signal in the event that said lifting instrument engages a portion of said cavity, and (d) extending the distal portion of said extraction instrument through said second opening in said cover member into said work space while said proximal portion of said extraction instrument is held outside of said work space, transferring said selected one of said anatomic members from said distal portion of said lifting instrument to said distal portion of said extraction instrument, and utilizing said extraction instrument to carrying said transferred anatomic member out of said work space through said second opening.

16. The method of claim 15 wherein said lifting instrument is constructed to simulate a conventional laparoscopic instrument, and wherein said method comprises operating said lifting instrument in a manner simulating the operation of said conventional laparoscopic instrument.

17. The method of claim 15 wherein said lifting instrument is constructed to simulate a first conventional laparoscopic instrument, wherein said extraction instrument is constructed to simulate a second conventional laparoscopic instrument, and wherein said method comprises operating said lifting instrument in a manner simulating the operation of said first conventional laparoscopic instrument and operating said extraction instrument in a manner simulating the operation of said second conventional laparoscopic instrument.

18. The method of claim 15 wherein said method additionally comprises the steps of:

(e) providing play money, and (f) award said player a predetermined amount of said play money for successfully removing a selected one of said anatomic members.

19. The method of claim 15 wherein said method additionally comprises the steps of:

(e) providing a plurality of cards, and (f) having said player select a card from said plurality of cards to indicate which of said anatomic members must be removed by said player.

* * * * *